US006188311B1

(12) United States Patent
Rothschild

(10) Patent No.: US 6,188,311 B1
(45) Date of Patent: Feb. 13, 2001

(54) MATERNITY AND LIFE TIME TRACKING APPARATUS AND METHOD OF USE

(75) Inventor: Margaret Perkins Rothschild, Valley Glen, CA (US)

(73) Assignee: RWL Millennium LLC, Van Nuys, CA (US)

( * ) Notice: Under 35 U.S.C. 154(b), the term of this patent shall be extended for 0 days.

(21) Appl. No.: 09/356,397

(22) Filed: Jul. 16, 1999

Related U.S. Application Data

(60) Provisional application No. 60/117,754, filed on Jan. 28, 1999.

(51) Int. Cl.[7] ..... G08B 1/00

(52) U.S. Cl. ..... 340/309.15; 340/309.4; 368/10; 368/108; 368/111; 368/244

(58) Field of Search ..... 340/309.15, 309.4, 340/815.69, 384.71; 368/111, 45, 63, 108, 244, 251, 10

(56) References Cited

U.S. PATENT DOCUMENTS 4,742,500 * 5/1988 Luce ..... 368/10
5,229,981 * 7/1993 Maschi ..... 368/111
5,691,932 * 11/1997 Reiner et al. ..... 368/10
5,888,117 3/1999 Sutton .
5,929,747 * 7/1999 Rosenblatt et al. ..... 340/309.15
5,999,492 * 12/1999 Teixeira ..... 368/10

* cited by examiner

*Primary Examiner*—Julie Lieu
(74) *Attorney, Agent, or Firm*—Blakely, Sokoloff, Taylor & Zafman LLP

(57) ABSTRACT

According to a preferred embodiment of the invention, an electronic apparatus and a method of its use are provided to keep track of events and elapsed time, during the life of a child, from a time prior to the child's birth. The apparatus has the functionality that helps satisfy the needs of parents who wish to commemorate events in the life of their child. Once the current time of day and/or date and the expected delivery date of the child have been programmed, the apparatus counts down the remaining period of time until birth in terms of months, weeks, and days. Upon reaching zero (delivery), the apparatus can be configured to perform certain celebratory acts, such as flash the display and play a tune. The apparatus then automatically switches to counting upwards and at any given moment thereafter will display the newborn's instantaneous age. As an alternative to the preferred method of use for tracking maternity and the delivery of a child, the user may program the apparatus with another type of expected event, such as an upcoming wedding, retirement, religious ceremony, or release from prison date.

20 Claims, 3 Drawing Sheets

MATERNITY AND LIFE TIME TRACKING APPARATUS AND METHOD OF USE

This application claims the benefit of the earlier filing date of U.S. Provisional Application No. 60/117,754, filed Jan. 28, 1999.

FIELD OF THE INVENTION

This invention is related to novelty items having timers.

BACKGROUND

Parents often want to know how old their child is at any given moment. Relying on personal memory is often not satisfying, particularly when there are many children to keep track of or when a fine resolution of the child's age, e.g., in terms of months, weeks, and days, is desired. Timers such as those found in general purpose stop watches can be used to track relatively short periods of time, i.e., hours and minutes. However, these battery operated devices are not suitable for tracking the relatively long period of time, months and years, associated with the life of a living being. There are other devices such as personal digital assistants which can be programmed to count down to an event, such as the year 2000 A.D., from months in advance. However, these are also for general purpose use and do not include certain functionality that is dedicated to the needs of prospective parents and their new born child.

SUMMARY

According to a preferred embodiment of the invention, an electronic apparatus and a method of its use are provided to keep track of events and elapsed time, during the life of a child, from a time prior to the child's birth. The apparatus has the functionality that helps satisfy the needs of parents who wish to commemorate events in the life of their child. Once the current time of day and/or date and the expected delivery date of the child have been programmed, the apparatus counts down the remaining period of time until birth in terms of months, weeks, and days. Upon reaching zero (delivery), the apparatus can be configured to perform certain celebratory acts, such as flash the display and play a tune. The apparatus then automatically switches to counting upwards and at any given moment thereafter will display the newborn's instantaneous age. The apparatus preferably displays the instantaneous age of the child in terms of months, weeks, and days. The apparatus may also include a log which allows the selection of one or more previously programmed events that relate to milestones in the child's life, to be recorded with a time of day and/or date stamp indicating when the event actually occurred.

As an alternative to the preferred method of use for tracking maternity and the delivery of a child, the user may program the apparatus with another type of expected event, such as an upcoming wedding, retirement, religious ceremony, or release from prison date. The apparatus will count down the remaining period of time until the expected event, and upon reaching zero will then automatically count up to display the elapsed time since occurrence of the expected event. This allows the user to instantly know how long it has been since her wedding, retirement or other special event. The apparatus is also expected to be a desirable gift item, particularly when combined as part of a wrist watch, a plush toy, or other novelty item.

Other features and advantages of the invention will be apparent from the accompanying drawings and from the detailed description that follows below.

BRIEF DESCRIPTION OF THE DRAWINGS

The invention is illustrated by way of example and not by way of limitation in the figures of the accompanying drawings in which like references indicate similar elements and in which.

DETAILED DESCRIPTION

Figure 1:
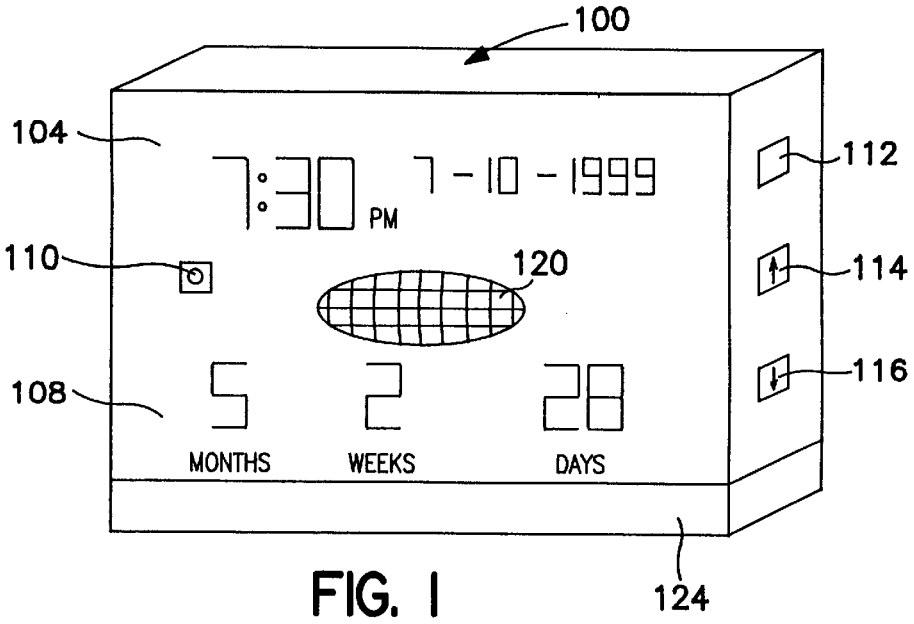
FIG. 1 shows a maternity and life time tracking apparatus according to a preferred embodiment of the invention.
Figure 9:
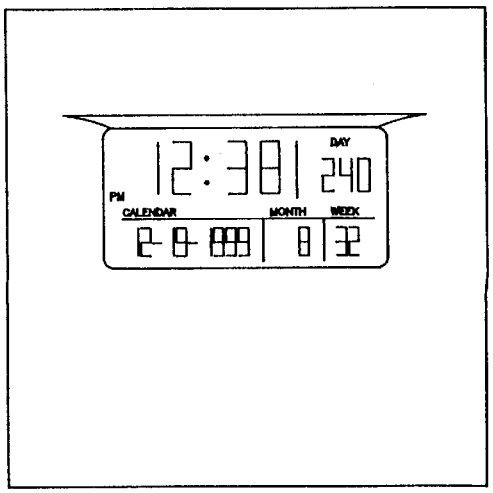

FIG. 1 illustrates a maternity and life time apparatus 100 according to an embodiment of the invention. References to "an" embodiment in this disclosure are not necessarily to the same embodiment, and mean at least one. In a simple version, the apparatus 100 includes a low-power, battery operated multi-function programmable clock having a liquid crystal display and a self contained light source for better viewing in darkness. A first portion 104 of the display indicates the current time of the day and/or date (month/day/year) (here referred to simply as "current time/date") while a second portion 108 indicates the remaining period of time as months, weeks, and days until the expected delivery. This can be arranged in different ways on the display, including for instance the arrangement shown in FIG. 9. The current time/date and the expected delivery date are entered using a conventional multi-button input interface. For instance, a recessed button 110 determines whether the apparatus is in program mode or in free running mode. In program mode, a button 112 is used to select between the various fields of the current time/date and the expected delivery date. Once the field has been selected, buttons 114 and 116 increase and decrease the value of the selected field. A speaker 120 allows an audio recording stored in the apparatus to be heard. The apparatus 100 may also feature a separate visual alert such as a lamp (not shown) that will be activated or flashed when the expected delivery date has been reached, and will continue to signal during the day of expected delivery. The apparatus 100 is powered by a high energy battery 124 which, when installed in the apparatus 100, will preferably have a life time of at least one year. Having discussed some of the external features of the apparatus 100, FIG. 2 illustrates some of the internal functionality of the apparatus 100.

Figure 2:
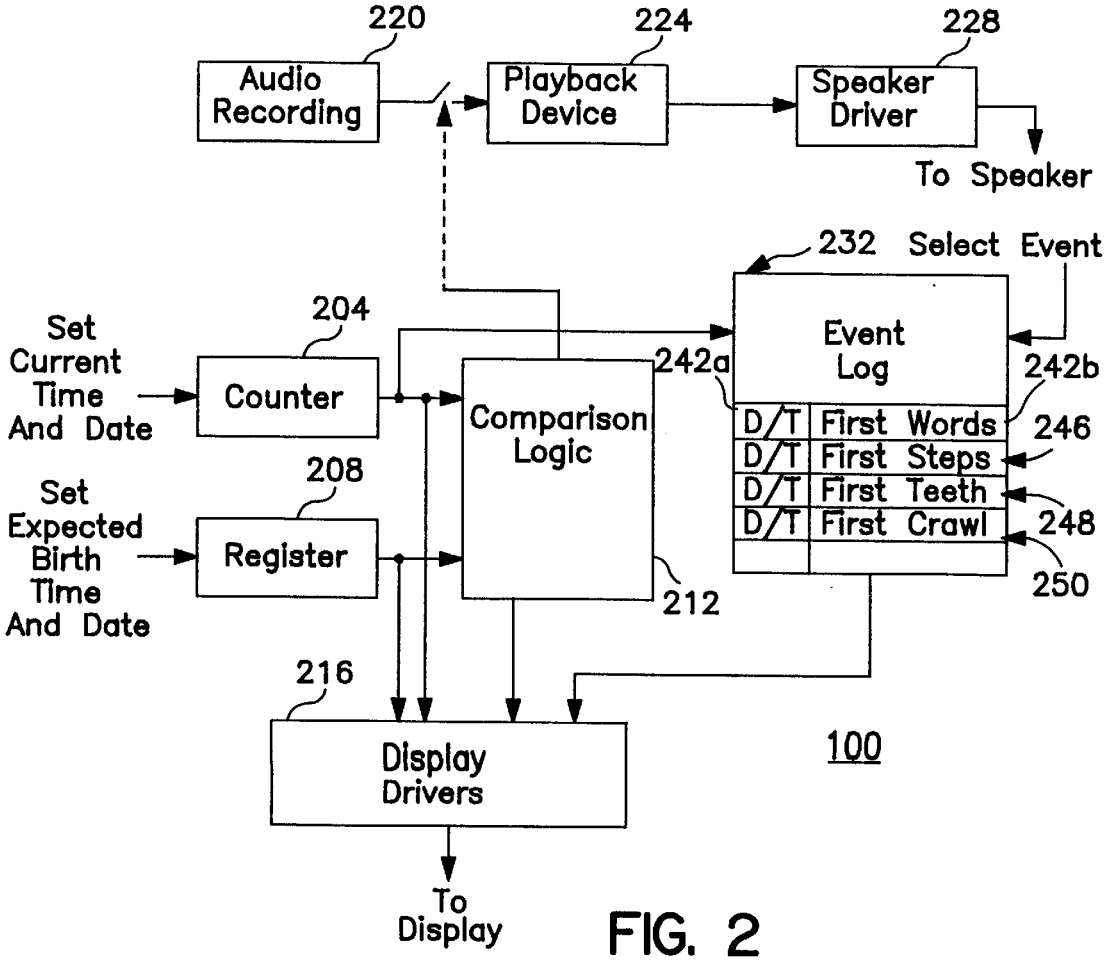
FIG. 2 is a functional block diagram of the tracking apparatus.

In FIG. 2, a counter 204 is configured as a clock to count elapsed time and provides an output of year, month, day of the month, hours, minutes, and seconds. The counter 204 can be programmed with the current time/date. A register 208 indicates the child's expected delivery date (month, day, and year) which has been programmed. Comparison logic 212 continuously computes the remaining period of time until birth by subtracting the programmed expected delivery time/date from the current time/date, which is then displayed preferably as months, weeks, days, using the display drivers 216. The current time/date and the expected delivery date are also fed to the display drivers 216. In the preferred embodiment, the comparison logic is further configured to flash the expected delivery date for a number of seconds, every several minutes. This may be done by alternating the second portion 108 of the display between the time period remaining and the expected delivery date.

The apparatus 100 also includes a storage device such as a read only memory (ROM) in which an audio recording 220 has been programmed. The audio recording may be in a compressed format, so that a playback device 224 uses a decoder to decompress the recording and feed it to a speaker driver 228 for playback. The flow of the audio recording is under the control of the comparison logic 212. The flow of audio begins when the comparison logic 212 determines that the child's expected delivery date has been reached. The audio recording may be, for instance, Brahm's Lullaby, the Star Spangled Banner, or other collection of single or multiple tunes.

An additional feature that may be included in the apparatus 100 is the ability to date and/or time stamp previously programmed events that relate to significant milestones in the life of the child. This feature uses an event log 232 which includes an in-circuit programmable, non-volatile memory in which a number of entries 242, 246, . . . have been created as in a database. Each entry in this database has several fields 242*a*, 242*b*, . . . , including at least a time/date stamp field 242*a* and an event description field 242*b*. The time/date stamp field 242*a* contains a time of day and/or date which identifies when the corresponding event, which is described in the field 242*b*, occurred. In this embodiment of the invention, the time of day and date to be stored in the event log 232 are automatically obtained from the free-running counter 204 when a particular event has been selected by the user to be updated. Alternatively, the time of day and date corresponding to the event can be manually programmed into the event log 232.

Figure 3:
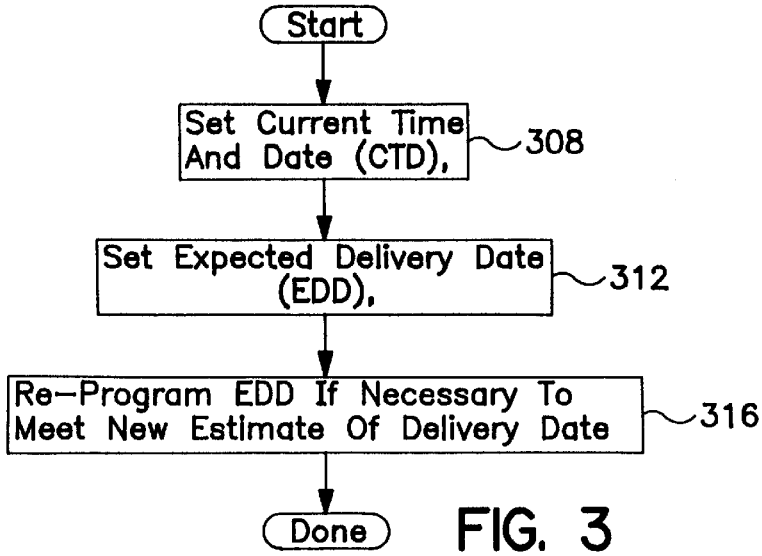
FIG. 3 is a flow diagram of actions performed by the user of the tracking apparatus.

FIG. 3 is a flow diagram of actions performed by the user programming the apparatus 100 according to an embodiment of the invention. Operation begins with step 308 in FIG. 3 in which the current time and date ("CTD") is programmed into the apparatus 100 by the user. The expected delivery date ("EDD") is programmed in step 312 based on an estimate of the delivery time of the child. In step 316, the EDD can be reprogrammed if necessary to meet a new estimate of the child's delivery date. In addition, the user can reprogram the EDD upon actual delivery of the child. Even if the user forgets or is unable to program the EDD before the actual delivery of the child, the apparatus can still be programmed with an EDD that is prior to the CTD. The comparison logic (see FIG. 2) will change the elapsed time to reflect the newly programmed EDD, and will continue to cause the correct elapsed time to be displayed. Once the EDD has been programmed, the apparatus 100 will count down the period of time remaining (if any) in months, weeks, and days until the programmed EDD. Once the CTD which is continuously being updated indicates a point in time that is later than the EDD, the apparatus 100 will count up by displaying the number of months, weeks, and days that have elapsed since the EDD. These particular operations are depicted in FIG. 4.

Figure 4:
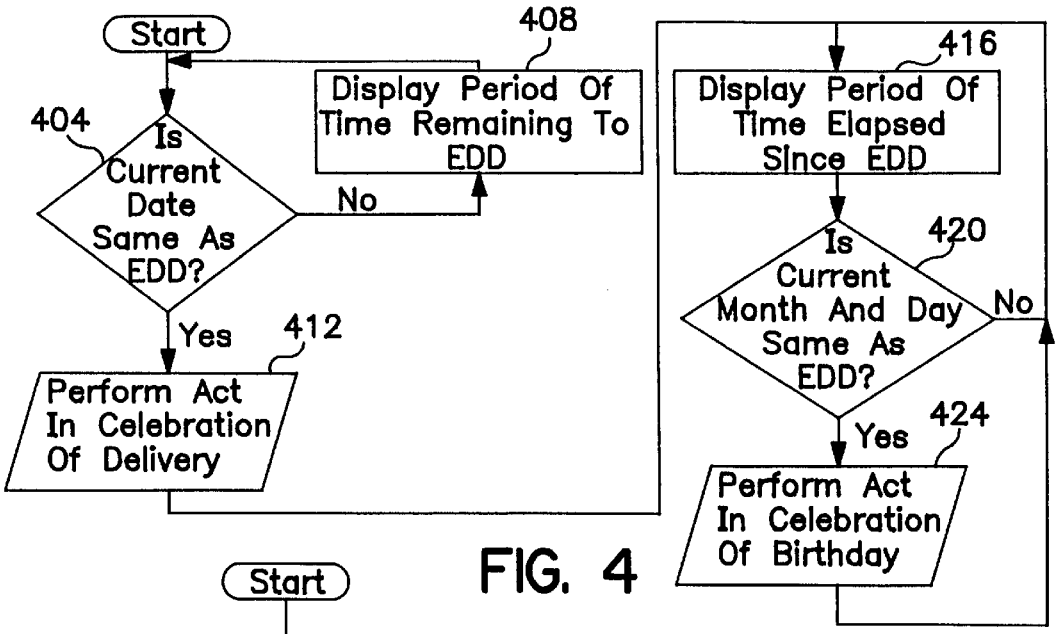
FIG. 4 depicts some actions performed by the apparatus.

In decision block 404 of FIG. 4, if the current date is the same as the programmed EDD, then operation continues with step 412 in which the apparatus 100 performs an act in celebration of the delivery of the child. If not, then operation loops back and displays in step 408 the period of time remaining to the programmed EDD. Upon performing the act in celebration of delivery in step 412, the apparatus 100 continues with step 416 in which the period of time elapsed since the programmed EDD is displayed. This period of time is preferably in terms of months, weeks, and days, and alternatively may also include the number of years that have elapsed since the year of delivery. Operation then continues with step 420 in which the current month and day, which is continuously being updated according to the free running counter/clock, is the same as the expected delivery month and day. This happens every year where the elapsed time being displayed resets to zero and continues to count up again. The apparatus 100 performs an act in celebration of the anniversary of delivery in step 424. The period of time elapsed since the programmed expected delivery date, i.e., the age of the child, is continuously being displayed as indicated in step 416. The act in celebration of the anniversary can be the same as the act that was performed in celebration of delivery, which may include single or multiple tunes, or it can be a happy birthday melody. The invention is not limited to any particular type of act in celebration of either delivery or the anniversaries.

Figure 5:
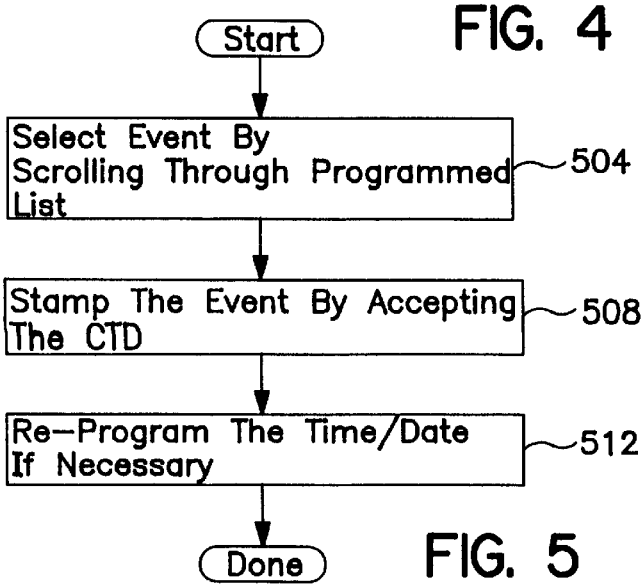
FIG. 5 illustrates a flow diagram of actions performed by the user in logging events in the apparatus during the life of a child.

FIG. 5 illustrates a flow diagram of actions performed by the user in logging special events during the life of the child, according to another aspect of the invention. Operation begins in step 504 in which the user may select an event by scrolling through a programmed list of events in the apparatus 100. These events pertain to milestones in the life of the child and may include, for instance, the time and date when the child first spoke, the time and date when the child took his/her first steps, the time and date when the child first crawled, and the time and date when the child's first teeth appeared. Once the user has selected the desired event, the event is then stamped by accepting the current time and date. The current time and date is thus associated with the event by being programmed into a non-volatile memory in the apparatus 100. If necessary, the user may reprogram this time and date, as in step 512, if the user was not able to stamp the event on the date at which it occurred.

Figure 6:
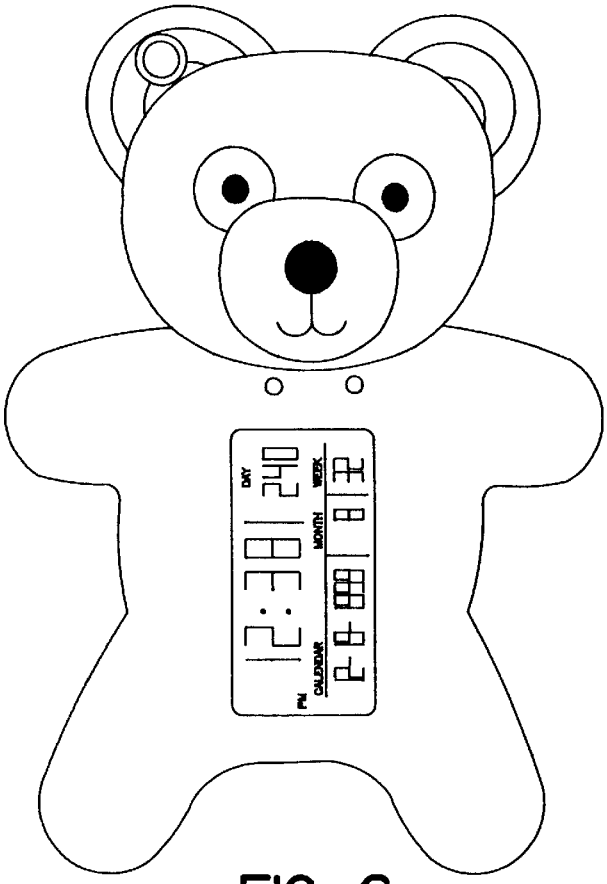
FIGS. 6–9 illustrate different environments for the tracking apparatus.
Figure 7:
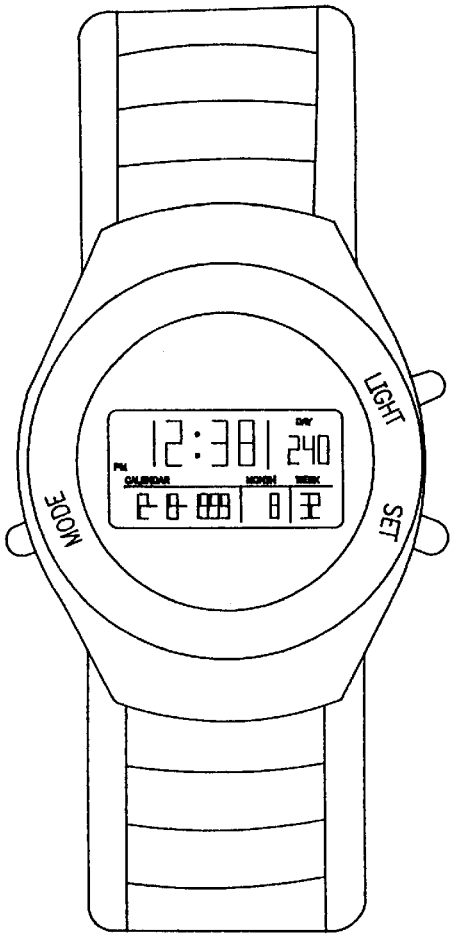
Figure 8:
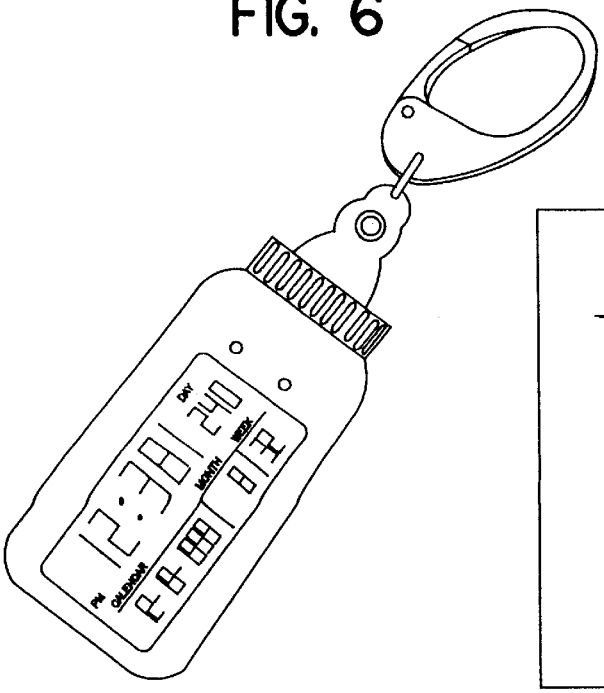

The above-described embodiments of the apparatus 100 and its methods of use can be featured in a variety of different embodiments, including for instance a wrist watch containing the apparatus 100 (see FIG. 7), a pendant holding the apparatus, the apparatus being attached to a key chain (see FIG. 8 in which the apparatus is embedded in a baby bottle), or the apparatus embedded into a plush toy such as a stuffed animal (see FIG. 6). In general, the apparatus 100 is portable and in the preferred embodiment will be small enough and light enough to be held in a person's hand.

To summarize, various embodiments of the invention directed to novelty items having a portable clock/timer apparatus with functionality that is used for tracking special events such as maternity have been disclosed. It will, however, be evident that various modifications and changes may be made thereto without departing from the broader spirit and scope of the invention as set forth in the appended claims. The specification and drawings are, accordingly, to be regarded in an illustrative rather that a restrictive sense.

What is claimed is:

1. An apparatus comprising:

means for programming an expected child delivery date, and at least one of a current time of the day and date;

means for displaying a period of time remaining until the expected delivery date;

means for displaying a period of time elapsed since the expected delivery date; and means for at least one of time and date stamping a plurality of entries that correspond to events that occur after the expected delivery date.

2. The apparatus of claim 1 further comprising means for performing a celebratory act upon reaching the expected delivery date.

3. The apparatus of claim 2 wherein the remaining period of time that is displayed includes the number of months, weeks, and days remaining until the expected delivery date.

4. The apparatus of claim 3 wherein the celebratory act includes playing an audio recording and flashing the display.

5. The apparatus of claim 3 further comprising:

means for displaying the expected delivery date; and means for alternating between displaying (1) the expected delivery date, and (2) the remaining period of time.

6. A method of tracking maternity and the age of a child, comprising:

programming a portable electronic apparatus as in claim 1 with an expected child delivery date and at least one of a current time and date;

reprogramming the expected child delivery date to a new time and date if the delivery schedule changes;

selecting, during the life of the child following her birth, an entry in the apparatus that corresponds to a milestone in the child's life; and at least one of time and date stamping the entry.

7. The method of claim 6 further comprising:

selecting one of a plurality of celebratory acts to be performed by the apparatus automatically upon reaching the expected delivery date.

8. A maternity and lifetime tracking apparatus comprising:

a counter to indicate the current time and date, the counter being programmable;

a register to indicate an expected child delivery date, the register being programmable;

comparison logic coupled to the counter and the register to compute a remaining period of time, in months, weeks, and days, until the expected delivery date, by subtracting the expected date from the current date;

a display being coupled to the counter to display the current time and date and being coupled to the register to display the expected delivery date, wherein the comparison logic is to compute a period of time in at least months, weeks, and days elapsed since the expected delivery date and feed the period of elapsed time to the display, so that the display can automatically change from displaying the time remaining to the elapsed time; and an event log that includes a plurality of entries each relating to a milestone in the life of a child, each entry having a field for containing at least one of a date and time stamp that can be programmed by a user of the apparatus, the event log being coupled to the display so that the contents of each entry can be displayed in response to the user's selection.

9. The apparatus of claim 8 further comprising:

a battery to power the apparatus such that the apparatus can operate and display the current time and date continuously for at least one year.

10. The apparatus of claim 9 further comprising:

a storage medium that contains an audio recording;

a playback device for generating an audio signal that represents the recording; and a speaker coupled to the playback device for audibilizing the audio signal, the comparison logic being configured to initiate playback of the recording upon reaching the expected delivery date.

11. The apparatus of claim 10 wherein the comparison logic is configured to cause the display to flash the expected delivery date at predetermined intervals.

12. The apparatus of claim 11 further comprising means for performing a second celebratory act upon reaching an anniversary of the expected delivery date.

13. The apparatus of claim 11 in combination with a plush toy.

14. An apparatus comprising:

means for programming an expected event date, and at least one of a current time of the day and date;

means for displaying a period of time remaining until the expected event;

means for displaying a period of time elapsed since the expected event, wherein the remaining period of time that is displayed includes the number of months, weeks, and days remaining until the expected event date; and means for at least one of time and date stamping a plurality of entries that correspond to events that occur after the expected event date.

15. The apparatus of claim 14 further comprising means for performing a celebratory act upon reaching the expected event.

16. The apparatus of claim 15 further comprising:

means for displaying the expected event date; and means for alternating between displaying (1) the expected event date, and (2) the remaining period of time.

17. A method of tracking an event, comprising:

programming a portable electronic apparatus as in claim 14 with an expected event date and at least one of a current time and date; and reprogramming the expected event date to a new time and date if the event schedule changes.

18. The method of claim 17 further comprising:

selecting one of a plurality of celebratory acts to be performed by the apparatus upon reaching the expected event date.

19. The method of claim 17 further comprising:

time and date stamping a plurality of entries that correspond to events that occur after the expected event date.

20. The method of claim 17 wherein the expected event date is an expected child delivery date.

* * * * *